US011851722B2

(12) United States Patent
Rabe et al.

(10) Patent No.: US 11,851,722 B2
(45) Date of Patent: Dec. 26, 2023

(54) CHROMIUM TANNING AGENTS

(71) Applicant: TFL Ledertechnik GmbH, Rheinfelden (DE)

(72) Inventors: Volker Rabe, Leverkusen (DE); Susanne Doeppert, Leverkusen (DE); Juergen Reiners, Leverkusen (DE)

(73) Assignee: TFL Ledertechnik GmbH, Rheinfelden (DE)

( * ) Notice: Subject to any disclaimer, the term of this patent is extended or adjusted under 35 U.S.C. 154(b) by 832 days.

(21) Appl. No.: 16/962,484

(22) PCT Filed: Jan. 11, 2019

(86) PCT No.: PCT/EP2019/050672
§ 371 (c)(1),
(2) Date: Dec. 14, 2020

(87) PCT Pub. No.: WO2019/141603
PCT Pub. Date: Jul. 25, 2019

(65) Prior Publication Data

US 2021/0102267 A1 Apr. 8, 2021

(30) Foreign Application Priority Data

Jan. 16, 2018 (EP) ..... 18151874

(51) Int. Cl.
*C14C 3/06* (2006.01)

(52) U.S. Cl.
CPC ..... *C14C 3/06* (2013.01)

(58) Field of Classification Search
CPC ..... C14C 3/06
See application file for complete search history.

(56) References Cited

U.S. PATENT DOCUMENTS

| | | | | |
|---|---|---|---|---|
| 3,174,817 | A | 3/1965 | Spahrkäs et al. | |
| 3,950,131 | A * | 4/1976 | Young | C14C 3/06 423/55 |
| 7,753,964 | B2 | 7/2010 | Hueffer et al. | |
| 2005/0069472 | A1 | 3/2005 | Candido et al. | |

FOREIGN PATENT DOCUMENTS

| | | | |
|---|---|---|---|
| CN | 1714158 | | 12/2005 |
| CN | 1714158 | A | 12/2005 |
| CN | 103014191 | A | 4/2013 |
| CN | 103215391 | | 2/2015 |
| CN | 105219893 | A | 1/2016 |
| CN | 105734183 | A | 7/2016 |
| RU | 2083673 | C | 7/1997 |

OTHER PUBLICATIONS

Cabeza et al. Processing of leather waste: pilot scale studies on chrome shavings. Isolation of potentially valuable protein products and chromium. Waste Management. vol. 18, Issue 3, Jun. 1, 1998, pp. 211-218.*

International Search Report from International Application No. PCT/EP2019/050672, dated Apr. 12, 2019, two pages.

Taiwan Search Report dated Oct. 5, 2022 for ROC Patent Application No. 108101295.

* cited by examiner

*Primary Examiner* — Amina S Khan
(74) *Attorney, Agent, or Firm* — Volpe Koenig

(57) ABSTRACT

The invention relates to specific chrome tanning agents and also to their use for the tanning of hides and skins, and to the leather and pelts obtainable as a result. It further provides a new process wherein the protein-masked chrome tanning agents of the invention are obtained from materials containing chromium and collagen, more particularly from leather production wastes such as leather shavings, for example. This enables recycling of chromium-containing leather production wastes, thereby permitting a significant reduction in the amount of such wastes, a fact which leads to considerable economic, environmental and logistical advantages.

20 Claims, No Drawings

CHROMIUM TANNING AGENTS

The invention relates to specific chrome tanning agents, to their preparation and also to their use for the tanning of hides and skins, and to the leather and pelts obtainable as a result.

In leather production, in the adjustment of the thickness known as shaving, small shavings of leather are obtained that consist primarily of collagenous material. Where the leather has been tanned beforehand using a chrome tanning agent, the tanned leather in the still-wet state, also referred to as wet blue, contains not only collagen but also usually around 2 to 6 wt % of chromium in the oxidation state (III).

Whereas the chromium (III) compounds present in expertly tanned leather are considered unobjectionable from the standpoint of health, incorrect tanning or deficient after-treatment of the leather or shavings may result in the formation of toxic or carcinogenic chromium(VI) compounds.

Given that chrome tanning represents the most widespread tanning method, large waste quantities of chromium-containing leather shavings are therefore produced (approximately 17 000 t per year in Germany alone). Separation into the protein and chromium constituents, and particularly the renewed use of the chromium fraction, which is possible only at high cost and complexity, mean that complete recycling of the large waste quantities is often uneconomic, with the consequence that leather shavings in their entirety are disposed of and landfilled as special waste, pressed to form bonded leather material, or burned under controlled conditions, albeit to the detriment of the environment. Moreover, a large quantity of collagen is lost in the process, which otherwise—that is, without contamination by chromium—could be used for cosmetics, for medicine, and for nutrition for humans and animals.

Common methods of separating protein and chromium include the decomposition of the leather shavings using acids or bases and/or using microbial or enzymatic breakdown with heating, these steps usually being combined with one another in a complicated, multi-stage operation.

Generally speaking, basic hydrolysis, possibly in combination with enzymatic hydrolysis, of leather shavings has the advantage that the protein fraction, as the component of greater economic interest, can be recovered in chromium-free form in the first step, as disclosed in DE4238979 A1, for example, where the protein fraction obtained as gelatin has a chromium content of <0.1 ppm.

In the case of acidic treatment, in contrast, the chromium is separated off first, with the aim of obtaining a protein fraction which as far as possible is free from chromium. The problem here is that after a single treatment of the chrome shavings with acid, a relatively high proportion of chromium still remains in the collagen. Thus Ferreira (Waste Management, 2010, 30, pp. 1091-1100) describes how, in a single, very long treatment time of 3-5 days with sulfuric acid, only 55-60% of the chromium can be recovered. The remaining protein residue still possesses such a high proportion of chromium (40-45%) and toxic Cr(VI) compounds resulting from the treatment that it cannot be disposed of via landfill. In order to achieve substantial removal of the chromium from leather, with the aim of being able to put the protein fraction to reasonable renewed use as in the case of the basic hydrolysis, a number of treatment steps with acid are required; however, in the acid solutions which are formed, the fraction of disruptive protein in solution is higher and higher and the concentration of the chromium steadily decreases, so making renewed use more difficult. The numerous acidic extraction steps needed in order to reduce the chromium content of the protein fraction to a level allowing it to be used in cosmetics, medicine or nutrition for humans and animals renders the entire operation uneconomic, however.

In US 2005/0069472 A, chrome shavings are subjected completely to acidic hydrolysis, and the chrome hydrolysate obtained is used as a tanning agent. In the example described, however, less than half of the chromium used is bound during tanning. As a result of the complete hydrolysis of the shavings, it is not possible to obtain a protein fraction.

Currently the method employed the most for the separation of protein and chromium is that of decomposition of the leather shavings using bases, optionally in combination with microbial and/or enzymatic breakdown with heating (as described, for example, in Cabeza, L.F., JALCA, 1998, 93, pp. 83-97). In the process described, the leather shavings are first decomposed with magnesium oxide to give not only gelatin but also a chromium-containing residue, referred to as the chrome cake. This cake is decomposed further by enzymes to give collagen hydrolysate and chromium-containing solids. The problem here is that the chrome cake cannot be used again directly as a tanning agent, since it still contains significant amounts of proteins which prevent the tanning effect. In order to remove this disruptive protein content, the chrome cake has in the prior art first been dissolved in sulfuric acid and then, in two further stages, the pH has been raised using sodium hydroxide in order to free the chromium-containing residue from the protein fraction. These steps each require a filtration step, which produces not only a large number of proteinaceous waste products that cannot be reused but also, ultimately, the purified chromium (III) sulfate, which can then be used again subsequently as a chrome tanning agent. The multiplicity of processing steps and the not inconsiderable fraction of proteinaceous waste products that cannot be reused are in opposition to the economics of the process.

Another process for working up the chrome cake is disclosed in CN103014191A. In this process, as in the above example, after basic hydrolysis of the shavings and removal of the protein, the chrome cake is dissolved in a strong acid, after which toxic and mutagenic Cr(VI) compounds are added in order to remove by oxidation the proteinaceous constituents that are still present. Subsequently a reducing agent is added in order to remove excess Cr(VI). This step must be carefully monitored, since, if chromium(VI) residues are not completely removed, it is not possible for the chrome tanning agent recovered in this way to be used again. The virtually protein-free chrome tanning agent thus recovered may subsequently be used as a chrome tanning agent. As far as the implementation of the process is concerned, however, the use of the Cr(VI) compounds imposes exacting safety requirements on the production facilities and the staff, and is therefore actually undesirable.

It is an object of the invention, therefore, to provide a simple process for the recycling of material containing chromium and collagen, and more particularly of leather shavings, which avoids the above-described disadvantages of the prior art.

Chrome tanning agents can be used directly in the form, for example, of chromium salts or solutions thereof, though for many applications it is advantageous to mask the tanning agents with organic acids, examples being aliphatic or aromatic carboxylic acids such as acetic acid, for example, or salts thereof. Examples of such chrome tanning agents are described in DE1230170B. Masked chrome tanning agents are known to be suitable for the gentle and more risk-free tanning, and also for the retanning, of leathers, and to have a relatively high alkali stability. The danger of the incidence of chrome spots during the neutralizing phase of tanning is reduced as a result. The leathers obtained have a better fullness and a softer feel. The grain appearance is particularly fine and smooth and the freedom from puckering is increased. Moreover, the colouring of the leather is more intense and more uniform, as disclosed for example in Bibliothek des Leders, Volume 3, "Gerbmittel, Gerbung, Nachgerbung" [Tans, Tannage, Retanning], Kurt Faber, 2nd edition, 1990, pages 79-80. Because of the masking, the degree of utilization of such tanning agents at the same final pH in the tanning is indeed somewhat below that of the unmasked chrome tanning agents; however, because of greater alkali stability on the part of the masked tanning agents, higher final pH levels can also be employed during tanning, and so the exhaustion achieved is comparable to that with unmasked chrome tanning agents, but is accompanied by higher leather quality.

The greater stability towards alkalis can be measured by determining the flocculation point, which is expressed as a percentage basicity.

The basicity of chrome tanning agents is a measure of the number of hydroxyl groups per chromium ion and as such is known to the skilled person. An explanation of the term and a method for determining the basicity are specified for example in Bibliothek des Leders, Volume 3, "Gerbmittel, Gerbung, Nachgerbung" [Tans, Tannage, Retanning], Kurt Faber, 2nd edition, 1990, pages 73-75 and pages 283-285.

In determining the flocculation point of masked chrome tanning agents, the amount of base up to the point of flocculation is measured, and the molar amount of hydroxide ions generated by the base is divided by three times the molar amount of chromium ions and added to the basicity value of the chrome tanning agent used. In this case, formally, at a basicity of 33.3% there is one hydroxide ion present per chromium ion, at a basicity of 66.6% there are two hydroxide ions present per chromium ion, and at a basicity of 100% there are three hydroxide ions present per chromium ion at the flocculation point. Because of the masking, larger amounts of base are necessary in some cases for precipitation to occur, and so basicity values may well exceed 100%.

The amount of base needed to change the basicity by 1% is known to the skilled person and amounts, for example, to 20.9 mg of $Na_2CO_3$ per 1000 mg of chromium oxide, calculated as $Cr_2O_3$ (cf. Bibliothek des Leders, Volume 3, "Gerbmittel, Gerbung, Nachgerbung" [Tans, Tannage, Retanning], Kurt Faber, 2nd edition, 1990, page 75).

The flocculation point is determined by preparing an aqueous solution of the chrome tanning agent (100 ml) that contains 2.6 wt % of chromium oxide, calculated as $Cr_2O_3$, stirring it continuously at room temperature for 8 h and titrating it with 1.5 molar aqueous sodium carbonate solution (dropping rate of 10 ml/min) until permanent flocculation is apparent.

Because the flocculation point is dependent not only on the initial concentration of chromium oxide in the solution under measurement but also on the stirring time after establishment of the chromium oxide content, the flocculation point in the case of the present invention is measured exactly 8 hours after establishment of the chromium oxide content of the solution at 2.6%, the solution having been stirred continuously at room temperature.

The above-described advantageous effect of the masking is manifested in particular in a flocculation point range of 66-150% basicity. Above 150%, overmasking is said by the skilled person to be present, and the chrome tanning agent enters only into very much reduced binding to the collagen, or into none at all, meaning that the tanning effect is greatly reduced or no longer exists. At a flocculation point of 65% basicity or less, masking is no longer effective.

A further object of the invention, therefore, was to provide a masked chrome tanning agent which is obtainable at least partly in an efficient and economic way from recycled material containing chromium and collagen.

Surprisingly it has now been found that to achieve the objects of the invention it is specifically not necessary to free the protein fraction from the insoluble residue obtainable in the basic hydrolysis of material containing chromium and collagen to the best possible extent, but instead that the protein fraction can be used successfully for masking the chrome tanning agent, provided that the flocculation point is established at a value in the range from 66 to 150% basicity.

The flocculation point here can be established by addition of chrome tanning agents, especially chromium(III) compounds, preferably one or more compounds selected from the group of chromium(III) oxides, chromium(III) hydroxides, chromium(III) halides and chromium(III) sulfates, and more preferably basic chromium(III) sulfate.

A subject of the invention is therefore a process for preparing protein-masked chrome tanning agents, comprising the following process steps:

- basic hydrolysis of at least part of the collagen fraction of a material containing chromium and collagen,
- removal of the insoluble constituents of the material obtained in the hydrolysis,
- dissolution of the insoluble constituents removed in the preceding step, by lowering of the pH to a value of 1 to 6, preferably of 1 to 3 and more preferably of 2.5,
- addition of chromium(III) compounds to the solution obtained in the preceding step until said solution has a flocculation point in the range from 66 to 150% basicity.

In a preferred embodiment the latter two process steps are combined by means of lowering the pH via the addition of acidic chromium(III) compounds. Suitable acidic chromium (III) compounds when mixed in a 1:9 ration with water show a pH at room temperature of less than 6.0, preferably less than 4.0 and most preferably less than 2.0. Preferably, chromium compounds selected from chromium(III) oxides, chromium(III) hydroxides chromium(III) halogenides and chromium(III) sulfates are employed and most preferably basic chromium(III) sulfate. Incidentally, the name of the latter is derived from the basicity of chrome tanning agents and not from the pH of its aqueous solution, which is <7. Other acidic chromium(III) compounds that can be employed in the present invention are obtained from the chromium residues remaining in the tanning liquor after the tanning process, which were separated by precipitated at an elevated pH and subsequently dissolved at a lower pH.

Protein-masked chrome tanning agents are understood here to be mixtures of chrome tanning agents, especially chromium(III) compounds such as chromium(III) oxides, chromium(III) hydroxides, chromium(III) halides and chromium(III) sulfates, and the protein fraction obtainable by basic hydrolysis of collagen.

The added chromium(III) compounds are preferably chromium(III) oxides, chromium(III) hydroxides, chromium(III) halides and/or chromium(III) sulfates or mixtures of these substances, more preferably basic chromium(III) sulfate.

The term "material containing chromium and collagen" embraces in its widest definition all materials containing chromium and containing collagen; chromium-containing leather is preferred, and chromium-containing leather shavings are particularly preferred.

The lowering of the pH is accomplished by addition of an acid, preferably of a mineral acid, more preferably sulfuric acid and/or hydrochloric acid, very preferably sulfuric acid.

Chromium-containing leather is understood to comprise hides and skins tanned by means of a chrome tanning agent and for which typically the shrinkage temperature of the tanned hide material is high enough to achieve at least hydrothermal stabilization of the hide material such as to allow subsequent processing by mechanical operations and to prevent damage caused by the mechanical and thermal exposure, as for example frictional heat during shaving.

The chromium oxide content in the material used that contains chromium and collagen is typically less than 10 wt %, more preferably less than 7 wt %, very preferably less than 5 wt %, based on the total mass of the dried material containing chromium and collagen at a residual moisture content of 10 wt %.

Basic hydrolysis refers to a reduction in the molecular weight of collagen under basic conditions. The basic hydrolysis is accomplished typically using oxides or hydroxides of the alkali and/or alkaline earth metals, preferably oxides or hydroxides of sodium, of potassium and/or of magnesium, more preferably magnesium oxide. The material obtained in this case comprises proteins, which typically have a weight-average molecular weight Mw of less than 310, preferably less than 280 and more preferably less than 250 daltons. In contrast to this, the proteins obtained in the acidic hydrolysis of material containing chromium and collagen possess a weight-average molecular weight $M_w$ of 320 daltons or more.

Attempts in the present invention to use the proteins obtained by acidic hydrolysis of chrome shavings instead of the proteins obtainable by basic hydrolysis of a material containing chromium and collagen did not produce a satisfactory tanning effect. It is presumed that the lower molecular mass of the proteins obtained by basic hydrolysis of collagen enables a higher penetration capacity on the part of the chrome tanning agents produced therewith and so achieves a better tanning effect in the cross section of the hide.

In one preferred embodiment, the protein-masked chrome tanning agent obtainable by the present process is obtained in the form of an aqueous solution. In a further embodiment, this solution is converted by drying, preferably spray drying, into a powder or granules.

A further subject of the invention is therefore protein-masked chrome tanning agents comprising chromium in the oxidation state 3 and proteins obtained by basic hydrolysis of collagen, wherein the chrome tanning agents have a flocculation point in the range from 66 to 150% basicity.

With preference not only the proteins but also a part of the chromium in the +3 oxidation state originate from the insoluble or sparingly soluble residue obtained in the basic hydrolysis of a material containing chromium and collagen. The other part of the chromium in the +3 oxidation state in that case originates from chrome tanning agents added to this residue, in the form of chromium(III) compounds, preferably chromium(III) oxides, chromium(III) hydroxides, chromium(III) halides and chromium(III) sulfates or mixtures of these substances, more particularly basic chromium(III) sulfate.

The chromium oxide content of the protein-masked chrome tanning agents, calculated as $Cr_2O_3$, is typically more than 5 wt %, preferably more than 8 wt % and more preferably from 10 to 26 wt %. This chromium oxide content is based on the total weight of the dried, protein-masked chrome tanning agents with a residual water content of ≤10 wt %, preferably of 5 wt %.

The amount of proteins obtained by basic hydrolysis of collagen in the protein-masked chrome tanning agents is typically from 2 to 50 wt %, preferably from 4 to 25 wt % and more preferably from 5 to 12 wt %. This protein content is based on the total weight of the dried, protein-masked chrome tanning agents with a residual water content of ≤10 wt %, preferably of 5 wt %.

The protein-masked chrome tanning agents obtainable by the present process typically possess a basicity of 0 to 65%, preferably 4 to 55%, more preferably 9 to 40%.

The protein-masked chrome tanning agents may be present in the form of a powder, granules, or an aqueous solution.

A further subject of the invention is the use of the protein-masked chrome tanning agents for the tanning and/or retanning of leather or pelts.

A further subject is a process for the tanning and/or retanning of leather or pelts by treatment of hide or skins with the protein-masked chrome tanning agents of the invention.

Moreover, the invention also embraces leather or pelts obtainable by the process of the invention for the tanning and/or retanning of leather or pelts.

The present invention is therefore outstandingly suitable for the recycling of material containing chromium and collagen, more particularly of leather production wastes such as leather shavings for example, which can be converted into advantageous protein-masked chrome tanning agents and can be returned to the tanning operation, thereby permitting a significant reduction in the amount of chromium-containing wastes during leather production, a fact which leads to considerable economic, environmental and logistical advantages.

EXAMPLES

The examples which follow elucidate the invention in more detail, without any intention that they should limit the invention.

Preparation of the Chrome Tanning Agents

The chromium-containing solution A used in the examples below comes from a commercially operated plant for the basic processing of the shavings of chrome-tanned cattle hide, which produces a residue containing chromium and collagen (chrome cake). This residue is dissolved using sulfuric acid and then the pH is adjusted to 2.3. The solution possesses a basicity of 9.1% and the chromium oxide content of the solution, calculated as $Cr_2O_3$, is 3.6%. The solids content is 35%. The flocculation point measured (for the solution diluted to 2.6% chromium oxide) is at 520% basicity.

The chrome tanning agent added in the examples is a pulverulent basic chromium sulfate (Chromosal®B from Lanxess Deutschland GmbH), which possesses a basicity of 33% and a chromium oxide content of around 26%, calculated as $Cr_2O_3$. The flocculation point measured for the solution diluted to 2.6% chromium oxide is at 62% basicity.

M1) Mixture of Chromium Solution A and Basic Chromium Sulfate

In a stirred flask, 103 g of water and 247 g of basic chromium sulfate are added to 650 g of the chromium-containing solution A. The solution is then heated to 80° C. and stirred at this temperature for 1 h.

The mixture possesses a basicity of 24% and contains 8.8% of chromium oxide, calculated as $Cr_2O_3$. The flocculation point for the solution diluted to 2.6% chromium oxide is at 89% basicity.

M2) Mixture of Chromium Solution A and Basic Chromium Sulfate

In a stirred flask, 505 g of water and 295 g of basic chromium sulfate are added to 200 g of the chromium-containing solution A. The solution is then heated to 80° C. and stirred at this temperature for 1 h.

The mixture possesses a basicity of 30% and contains 8.4% of chromium oxide, calculated as $Cr_2O_3$. The flocculation point for the solution diluted to 2.6% chromium oxide is at 72% basicity.

M3) Mixture of Chromium Solution A and Basic Chromium Sulfate

In a stirred flask, 288 g of water and 412 g of basic chromium sulfate are added to 300 g of the chromium-containing solution A. The solution is then heated to 80° C. and stirred at this temperature for 1 h.

The mixture possesses a basicity of 30% and contains 11.8% of chromium oxide, calculated as $Cr_2O_3$. The flocculation point for the solution diluted to 2.6% chromium oxide is at 76% basicity.

M4) Mixture of Chromium Solution A and Basic Chromium Sulfate

In a stirred flask, 155 g of water and 545 g of basic chromium sulfate are added to 300 g of the chromium-containing solution A. The solution is then heated to 80° C. and stirred at this temperature for 1 h.

The mixture possesses a basicity of 31% and contains 15.2% of chromium oxide, calculated as $Cr_2O_3$. The flocculation point for the solution diluted to 2.6% chromium oxide is at 69% basicity.

Performance Examples Using the Chrome Tanning Agents

Use Example 1: Tanning

The starting material used comprises (cattle) pelts which have been split and weighed after liming and whose thickness is approximately 1.8-2.0 mm. All of the following amounts for use of chemicals are based on this reference weight (pelt weight).

After customary preparatory operations with which the skilled person is familiar, 18% of the chrome tanning agent prepared in example M1, in the form of a solution, is added to the pickled pelts, and treatment is carried out for 60 min. This is followed by addition of magnesium oxide, as a slow-acting, alkalizing product. The pH of the solution climbs as a result from 2.6 after addition of the chrome tanning agent to a final pH of 3.8 within 8 h. The temperature is likewise increased, from 20° C. initially to 40° C. Table 1 sets out the steps in the process of the invention for producing semi-finished leather products (the wt % are based on the pelt weight).

TABLE 1

| Process | wt % | Chemicals | Run time [min] | Remarks |
|---|---|---|---|---|
| | 200 | Water 32° C. | 10' | Drain float |
| | 50 | Water 32° C. | | |
| | 1.5 | Ammonium chloride | | |
| | 0.2 | Na bisulfite | 45' | Cut with phenolphthalein: colourless, pH 8.6 |

TABLE 1-continued

| Process | wt % | Chemicals | Run time [min] | Remarks |
|---|---|---|---|---|
| | | | | Drain float |
| | 50.0 | Water 35° C. | 5' | |
| | 0.20 | PELTEC ADN 1:5 | | |
| | 0.15 | LEVAZYM AF | 60' | |
| | | | | Drain float |
| | 100 | Water 20° C. | | |
| | 6.0 | Sodium chloride | 5' | |
| | 0.4 | Formic acid 1:10 | 10' | |
| | 0.8 | Sulfuric acid 1:10 | 90' | pH 3.4 |
| | 18 | Mixture M1 | | |
| | | | 60' | |
| + | 0.4 | BLANCOROL BA-I | 480' | |
| pH 3.8 | | | | Automatic 40° C. Drain float |

After the process of the invention, the semi-finished leather products are stored on a trestle, sammied and shaved.

The wet blues have a shrinkage temperature of >100° C. and a $Cr_2O_3$ content of 4.1%. The $Cr_2O_3$ content of the residual float is 4.2 g/l.

The wet blues thus produced are notable in particular for good fullness and a soft feel. The grain appearance is particularly fine and smooth and there is increased absence of puckering.

Use Example 2: Tanning

As use example 1, but with final pH of 4.2.

The wet blues have a shrinkage temperature of >100° C. and a $Cr_2O_3$ content of 4.4%. The $Cr_2O_3$ content of the residual float is 2.1 g/l.

The wet blues thus produced, in spite of the increased final pH, show no chromium precipitation at all and possess an attractive blue colour. The fullness, the feel, the grain appearance and the absence of puckering are comparable with use example 1.

Use Example 3: Tanning

As use example 1, only with 14.5% of the chrome tanning agent prepared according to example 3. Final pH 3.8.

The wet blues have a shrinkage temperature of >100° C. and a $Cr_2O_3$ content of 4.3%. The $Cr_2O_3$ content of the residual float is 2.7 g/l.

The wet blues thus produced are notable in particular for good fullness and a soft feel. The grain appearance is particularly fine and smooth and the absence of puckering is increased.

Use Example 4: Tanning

As use example 3, but with final pH of 4.1.

The wet blues have a shrinkage temperature of >100° C. and a $Cr_2O_3$ content of 4.6%. The $Cr_2O_3$ content of the residual float is 1.9 g/l.

The wet blues thus produced, in spite of the increased final pH, show no chromium precipitation at all and possess an attractive blue colour. They likewise possess good fullness and a soft feel. The grain appearance is particularly fine and smooth and the absence of puckering is increased.

Comparative Example 1: Tanning

As use example 1, only with 6.5% basic chromium sulfate (Chromosal® B).

Final pH 3.8.

The wet blues have a shrinkage temperature of >100° C. and a $Cr_2O_3$ content of 4.5%. The $Cr_2O_3$ content of the residual float is 2.0 g/l.

The wet blues thus produced, compared to the wet blues produced using the chrome tanning agents of the invention, have a greener colour. Moreover, they possess less fullness and a harder feel. The grain appearance is coarser and the lack of puckering is lower.

Use Example 5: Retanning

Semi-finished leather products shaved to a thickness of 1.1 mm are treated by customary preparatory operations with which the skilled person is familiar, such as washing, then admixed with 12% of the chrome tanning agent prepared in example M1, in the form of a solution, and treatment is carried out for 60 min. Then a slowly neutralizing Syntan (Tanigan® PAK from LANXESS Deutschland GmbH) and product with an alkalizing activity are added, and the pH is raised to 5.1.

This was followed by application of a typical retanning formula for the production of furniture crust leather.

Table 2 sets out the steps of the process of the invention for producing crust leather (the wt % are based on the shaved weight).

TABLE 2

| Material: wet blue | | | | mm: 1.0-1.1 | |
|---|---|---|---|---|---|
| Process | % | | Chemicals | min | Remarks |
| | 300 | | Water 40° C. | | |
| | 0.4 | | BLANCOROL CGA | 15' | |
| | 0.3 | | Peltec SW | | |
| pH | | 4.1 | | | Drain float |
| | 200 | | Water 45° C. | | |
| | 12.0 | | Mixture M1 | 60' | |
| pH | | 3.4 | | | |
| | 2.0 | | TANIGAN PAK | | |
| | 1.0 | | Sodium formate | 10' | |
| + | 1.0 | | Sodium bicarbonate | 60' | |
| pH | | 5.1 | | | |
| | | | | | Drain float |
| | 50 | | Water 35° C. | | |
| | 4.0 | | X-Biomer P 1:4 | | |
| | 4.0 | | TANIGAN BN 1:4 | 20' | |
| | 5.0 | | TANIGAN VR | | |
| + | 3.0 | | Chestnut tanning agent | | |
| | 2.0 | | TANIGAN PR | 10' | |
| | 2.0 | | BAYKANOL TF 2N | | |
| | 2.0 | | BAYGENAL Red GT | 30' | |
| + | 8.0 | | LEVOTAN XB | | |
| | 6.0 | | LEVOTAN W 1:4 | 60' | |
| + | | | | | Heating to 50° C. |
| | 3.0 | | Formic acid 85% 1:5 | 30' | |
| pH | | 3.3 | | | Drain float |
| + | | | | | |
| | 300 | | Water 50° C. | 10' | Drain float |
| | 300 | | Water 20° C. | 10' | Drain float |

Vacuum drying, milling

The crust leathers produced in this way are notable particularly for good fullness and a soft feel. The grain appearance is particularly fine and smooth and the absence of puckering is increased. The colouring of the crust leathers is notably intense and uniform.

What is claimed is:

1. Protein-masked chrome tanning agents comprising chromium in the oxidation state 3 and proteins obtained by basic hydrolysis of collagen, wherein the chrome tanning agents have a flocculation point in the range from 66 to 150% basicity, and the flocculation point is determined by preparing an aqueous solution of the chrome tanning agent containing 2.6 wt % of chromium oxide, calculated as $Cr_2O_3$, stirring the solution continuously at room temperature for 8 h and titrating it with 1.5 molar aqueous sodium carbonate solution until permanent flocculation is apparent.

2. Protein-masked chrome tanning agents according to claim 1, wherein the chromium oxide content, calculated as $Cr_2O_3$, is more than 5 wt %.

3. Protein-masked chrome tanning agents according to claim 1, wherein the amount of proteins obtained by basic and/or enzymatic hydrolysis of collagen is from 2 to 50 wt %.

4. Protein-masked chrome tanning agents according to claim 1, which have a basicity of 0 to 65%.

5. Protein-masked chrome tanning agents according to claim 1, present in the form of a powder, granules or an aqueous solution.

6. Protein-masked chrome tanning agents according to claim 2, wherein the chromium oxide content, calculated as $Cr_2O_3$, is more than 8 wt %.

7. Protein-masked chrome tanning agents according to claim 3, wherein the amount of proteins obtained by basic and/or enzymatic hydrolysis of collagen is from 4 to 25 wt %.

8. Protein-masked chrome tanning agents according to claim 4, which have a basicity of 4 to 55%.

9. Process for preparing protein-masked chrome tanning agents, comprising the following process steps:

(i) hydrolyzing at least part of the collagen fraction of a material containing chromium and collagen by basic hydrolysis, (ii) removing the insoluble constituents of the material obtained in the basic hydrolysis, (iii) dissolving the insoluble constituents removed in step (ii), by lowering of the pH to a value of 1 to 6, (iv) adding chromium(III) compounds to the solution obtained in step (iii) until said solution has a flocculation point in the range from 66 to 150% basicity.

10. Process according to claim 9, wherein the chrome tanning agents added are one or more chromium(III) compounds.

11. Process according to claim 9, wherein the material containing chromium and collagen comprises chromium-containing leather.

12. Process according to claim 9, wherein the lowering of the pH is accomplished by addition of an acid.

13. Process according to claim 9, wherein the basic hydrolysis is accomplished using oxides or hydroxides of the alkali and/or alkaline earth metals.

14. Process according to claim 9, wherein the masked chrome tanning agents possess a basicity of 0 to 65%.

15. Process according to claim 9, wherein after adding chromium(III) compounds in step (iv), drying takes place.

16. Process according to claim 9, wherein the process step comprising lowering the pH and the process step comprising adding chromium(III) compounds are combined in a process step comprising the lowering of the pH by adding acidic chromium(III) compounds.

17. Process for the tanning and/or retanning of leather or pelts by treatment of hides or skins with protein-masked chrome tanning agents according to claim 1.

18. Process according to claim 10, wherein the chrome tanning agents added are chromium(III) compounds selected from chromium(III) oxides, chromium(III) hydroxides, chromium(III) halides and chromium(III) sulfates and mixtures of these substances.

19. Process according to claim 12, wherein the lowering of the pH is accomplished by addition of a mineral acid.

20. Process according to claim 13, wherein the basic hydrolysis is accomplished using oxides or hydroxides of sodium, potassium and/or magnesium.

* * * * *